US005732733A

United States Patent [19]

Negus et al.

[11] Patent Number: 5,732,733

[45] Date of Patent: Mar. 31, 1998

[54] AIR HOSE REEL

[75] Inventors: Joel A. Negus, Clarinda, Iowa; Terry K. Robins, Minneapolis, Kans.

[73] Assignee: Lisle Corporation, Clarinda, Iowa

[21] Appl. No.: 712,333

[22] Filed: Sep. 11, 1996

Related U.S. Application Data

[63] Continuation-in-part of Ser. No. 590,390, Jan. 25, 1996, Pat. No. 5,666,992.

[51] Int. Cl.[6] ..... B65H 75/34

[52] U.S. Cl. ..... 137/355.27; 137/315; 242/395; 242/604

[58] Field of Search ..... 242/395, 404, 242/597.4, 604; 137/355.26, 355.27, 315

[56] References Cited

U.S. PATENT DOCUMENTS

| | | | |
|---|---|---|---|
| 1,354,369 | 9/1920 | Anderson | 242/604 |
| 1,886,207 | 11/1932 | Marshall et al. | 137/355.26 |
| 2,047,705 | 7/1936 | Porter . | |
| 2,635,008 | 4/1953 | Nelson . | |
| 3,343,723 | 9/1967 | Richards . | |
| 3,433,247 | 3/1969 | Haselden . | |
| 3,633,843 | 1/1972 | Sutton | 242/395 |
| 3,977,429 | 8/1976 | Stevenson | 137/355.27 |
| 4,137,939 | 2/1979 | Chow . | |
| 4,311,165 | 1/1982 | Rose, Jr. . | |
| 4,446,884 | 5/1984 | Rader, Jr. . | |
| 4,537,215 | 8/1985 | Roman . | |
| 5,109,882 | 5/1992 | Eley . | |
| 5,284,181 | 2/1994 | Wang . | |
| 5,381,820 | 1/1995 | Chandler . | |
| 5,392,808 | 2/1995 | Pierce . | |

*Primary Examiner*—A. Michael Chambers
*Attorney, Agent, or Firm*—Banner & Witcoff, Ltd.

[57] ABSTRACT

An air hose reel is formed by an upright L-shaped support horizontally journalling an axle having reel forming spokes secured to one end portion for angular rotation in a vertical plane. A tension spring and friction washers surround the axle for retarding free wheeling movement of the reel. Couplings at respective ends of the axle are connected with air hose.

7 Claims, 4 Drawing Sheets

AIR HOSE REEL

CROSS REFERENCE TO RELATED APPLICATION

This is a continuation in part of U.S. application Ser. No. 05/590,390 filed Jan. 25, 1996, now U.S. Pat. No. 5,666,992 for an Air Hose Reel in the name of Terry K. Robins.

BACKGROUND OF THE INVENTION

1. Field of the Invention

This invention relates to compressed air equipment and, more particularly, to an air hose reel for winding up and paying out an air hose having greater than atmospheric pressure.

A compressed air hose is usually considered a necessary part of an automotive service shop. It is also desirable to have a reel for winding the hose for storage in an out-of-the-way and yet readily accessible position. This invention accomplishes this purpose.

2. Description of the Prior Art

U.S. Pat. No. 5,381,820 issued Jan. 17, 1995 to Chandler for Hose Reel Apparatus discloses an inverted U-shape bracket mounted on the handle of a portable air compressor which horizontally journals a reel between the legs of the U-shape bracket. The bight portion of the U-shape bracket forms a guide track for guiding a hose when wound on the reel to form multiple layers of juxtaposed convolutions of the hose.

U.S. Pat. No. 4,311,165 issued Jan. 19, 1982 to Rose, Jr. for Hose Reel Automatic Rake, discloses a hose wound on a reel journaled on a horizontal axis which includes a brake mechanism energized by opening the exit end of the hose so that fluid pressure in the hose also energizes a brake to stop the uncoiling action of the hose from the reel.

U.S. Pat. No. 4,137,939 issued Feb. 6, 1979 to Chow for Hose Reel Cart, and U.S. Pat. No. 4,537,215 issued Aug. 27, 1985 to Roman for Portable Winding Device for Flexible Pipe, particularly for cars, caravans, coaches, crafts, balconies and small gardens, are believed good examples of the further state-of-the-art. The Chow patent mounts a cylindrical reel on a two-wheel cart manually supported by a handle forming a portable hose reel cart. The Roman patent discloses a fixed casing which rotatably supports a drum around which a hose is manually wound on or payed out from.

This invention is believed distinctive over the above-named patents by providing an open framework type reel and support which is simple in operation and ease of construction, and contains a minimum of moving parts which will not easily get out of order and provides a long useful life as an air hose reel.

SUMMARY OF THE INVENTION

A pair of spokes disposed in crossed relation and having U-shaped end portions disposed in 90° radial relation forms a reel supported in cantilever fashion on one end of a horizontal shaft journalled by an upright bracket removably secured to a base. A handle on one of the reel spokes winds up an air hose on the reel.

The principal object of this invention is to provide a pneumatic hose reel easily mounted in any convenient location for manually winding up and paying out the working end of an air hose.

DETAILED DESCRIPTION OF THE PREFERRED EMBODIMENT

Figure 1:
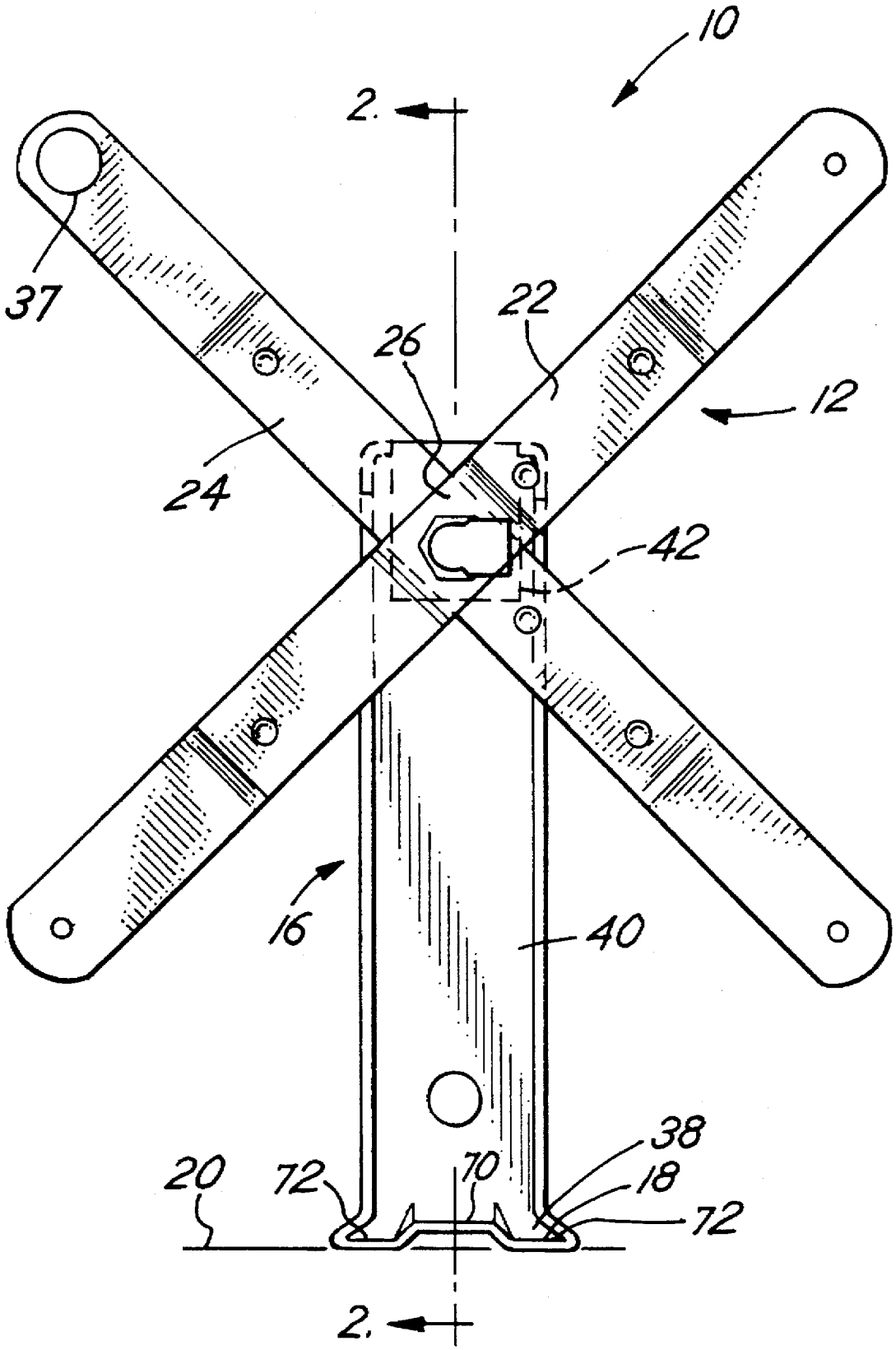
FIG. 1 is a front elevational view.

Like characters of reference designate like parts in those figures of the drawings in which they occur.

In the drawings:

The reference numeral 10 indicates the hose reel which comprises a reel means 12 supported in cantilever fashion on one end portion of a horizontal axle means 14 journaled at its other end portion by a bracket 16 removably supported by a base 18 secured to a horizontal support surface 20.

The reel means 12 comprises a pair of strap irons 22 and 24 disposed flatly in orthogonal relation and transversely bored at their junction, as at 26, for receiving one end portion of the axle means axle 28. A pair of lock nuts 30 and a lock washer 31 secure the reel means 12 to the external threads 29 of the axle 28. The respective end of each spoke 22 and 24 is bifurcated to form an outwardly open U-shape defined by a pair of legs 32 and 34 and a bight portion 36. An outstanding handle 37 is secured to one of the legs 34 for manually rotating the reel.

The bracket means 16 is similarly formed from strap iron material doubled back upon itself in flat contiguous relation to form an upright L-shaped as seen in side elevation with its foot portion 38 horizontally disposed and received by the base 18 with its vertical leg portion 40 defining a bracket loop formed by separating the strap iron to form a single thickness upper leg end portion 41 and a parallel relatively short wall 42 overhanging the foot portion 38 in parallel spaced relation with respect to the single thickness leg end portion 41 and short wall 42 are horizontally line drilled, as at 44 and 45, for journalling the end portion of the axle means axle 28 opposite its externally threaded end portion 29.

A pair of friction washers 46 and 47 surround the axle end portion 28 opposite its external threads and on opposite sides of the leg end portion 41. A retainer clip 48 entering an axle groove 50 at its end portion opposite the external threads maintains the axle journalled by the bracket aperture 44.

An E-clip 52 is disposed in a second axle groove 54 adjacent the short wall 42. A third friction washer 56 surrounds the axle adjacent the E-clip on its side opposite the short wall 42. A tension spring 58 having end cups 60 and 62 nesting its respective end portions, is interposed between the friction washers 47 and 56 around the axle 28. The tension spring 58 maintains constant frictional contact with opposite sides of the leg portion 41 by the friction washers 46 and 47 which impedes free wheeling angular rotation of the reel means 12 about the axis of the axle 28, and yet permits manual rotation of the reel means 12 by the handle 37 for winding up or paying out a hose by manually pulling on its free end.

The axle 28 is further characterized by internal threads at its respective end portions as at 64, only one being shown.

A street ell 66 is secured to the axle at its externally threaded end portion for connection with one end of an air hose 67 supported by the reel means 12. Similarly, a conventional right angular swivel 68 is threadably connected with the internal threads 64 at the other end portion of the axle for connection with a source of compressed air, not shown.

Figure 3:
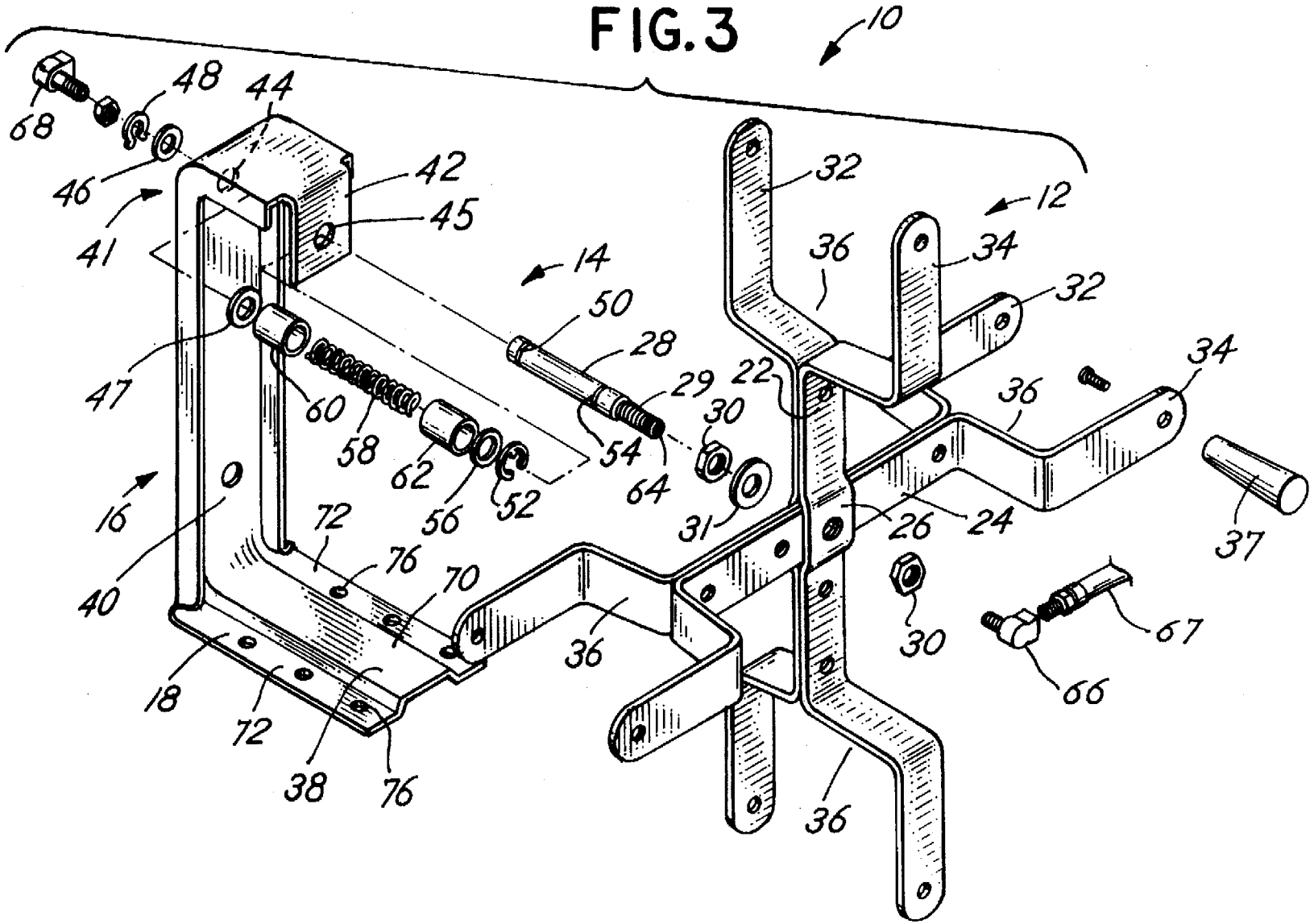
FIG. 3 is an exploded perspective view.

As viewed in FIG. 3, the base is rectangular plate-like in general configuration having its central longitudinal portion struck upwardly to form a bridge 70 between its lateral edge portions 72 within one end portion of the bridge arcuately turned upward to define a recess 74 between the bridge 70 mad the support surface 20 which slidably receives the foot portion 38 of the bracket means 16. The base lateral edge portions 72 are apertured as at 76 for anchoring the base to the support surface 20.

Figure 4:
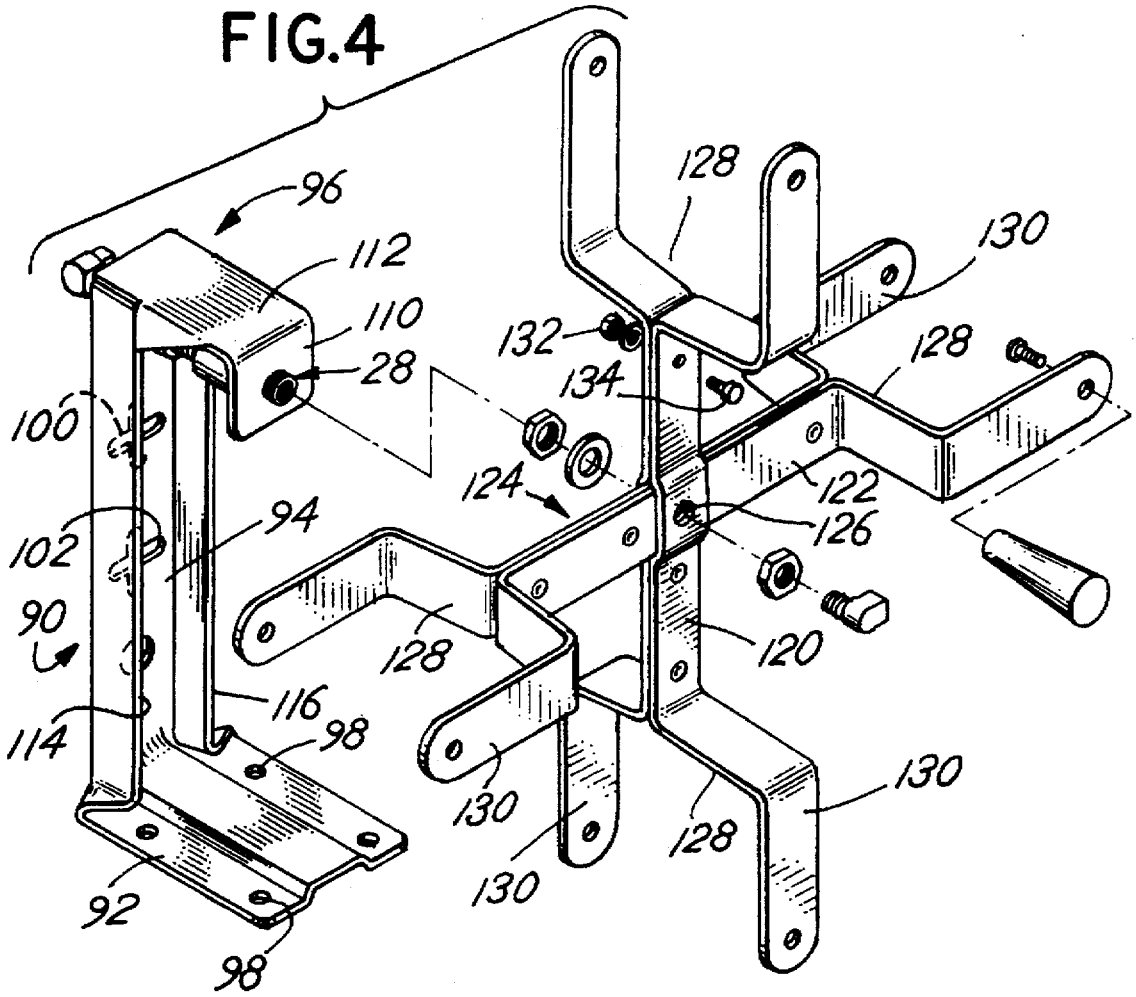
FIG. 4, is an exploded perspective view of a second embodiment of the invention.
Figure 5:
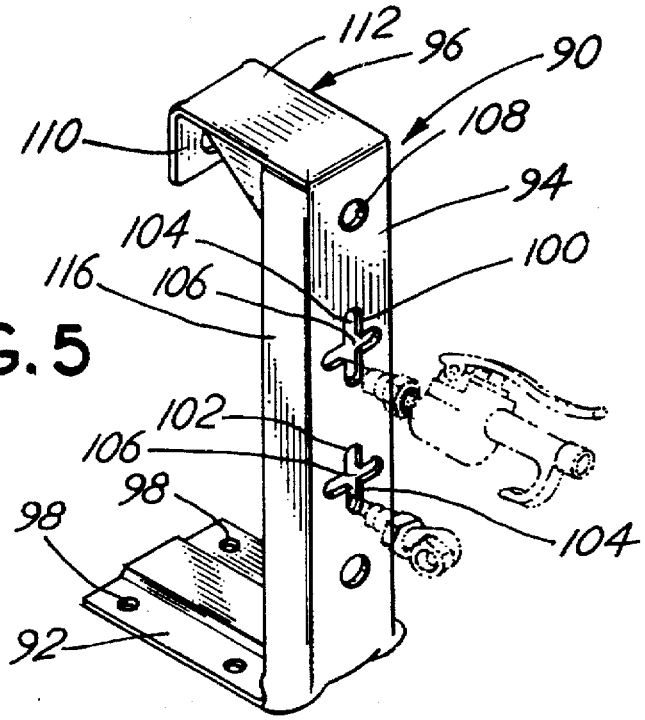
FIG. 5, is a perspective view of the support for the air hose reel of the invention depicting a slot configuration for holding various air nozzles and air tools regardless of the orientation of the air hose reel.

FIGS. 4 and 5, illustrate an alternative embodiment of the invention and some additional features of the invention. Thus, referring to FIG. 4, an exploded perspective view of a second embodiment of the invention, there is shown a support 90 which is comprised of a base plate 92 and upwardly extending support or leg 94 having an upper end 96 spaced from the base plate 92. The base plate 92 includes various openings 98 so that the plate 92 may be attached to a wall or floor or some other support surface. The leg or support arm 94 is sufficiently long so that the reel (described below) will have clearance between the base plate 92 and the upper end 96.

The support leg 94 includes one or more cruciform slots 100 and 102. The cruciform slots 100, 102 are defined by orthogonal or right angle slot passages which meet at a central or axis point. The slot sections or passages such as passage or slot section 104 are sized to receive the head of an air hose nozzle, for example, through the center portion 106. But the passage slot side section 104 is sized so that a recessed groove adjacent the head of an air nozzle, for example. will be received and snugly held in the slot section 104. Note that by providing a cruciform slot such as slot 100 or 102, the head of a nozzle, for example, would be retained regardless of the orientation of the support of leg 94. That is, one radial slot passage 104 is always arranged in an orientation such that it will retain the air nozzle head regardless of the orientation of the leg 94. Note also, the slots 100, 102 are cruciform, but that other arrangements may be provided, such as three slots meeting at a central axis or other multi-pegged or multi-slotted forms.

The support 90 further includes a throughbore or opening 108 at the upper end of 96. The upper end 96 thus defines a first arm. A second arm 110 is spaced from the upper end 96 by a cross member or crown 112. Support leg 94 includes opposite side parallel side flanges 114 and 116 which extend the length of the support arm 94 and also along the crown 112. This construction provides improved rigidity and structural integrity for the support 90. This construction also eliminates the need of a cross member or brace such as depicted in the first embodiment described with respect to FIGS. 1–3.

Figure 2:
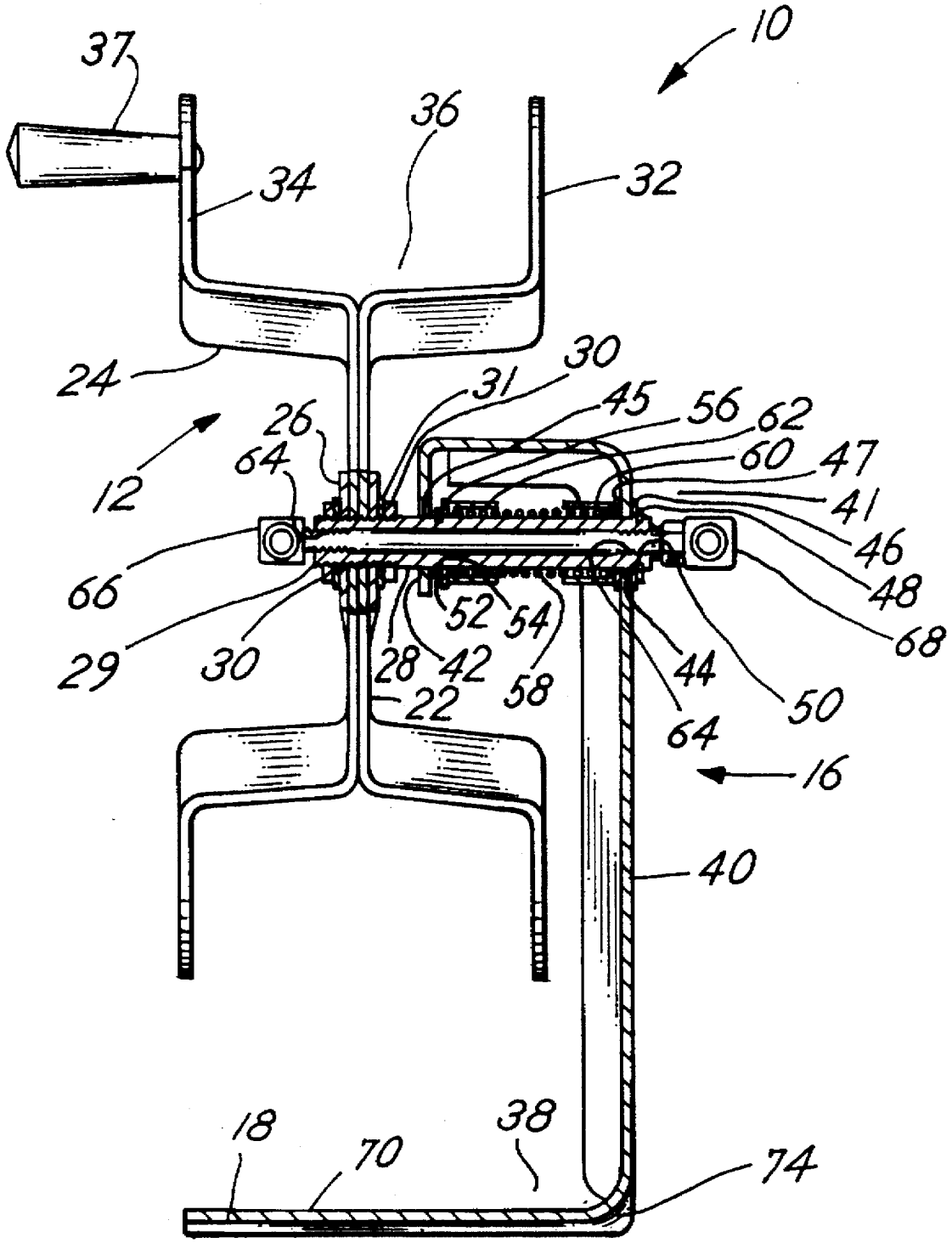
FIG. 2 is a left side elevational view partially in section looking in the direction of the arrows 2—2 of FIG. 1.

In any event the construction of the hollow axle 28 and the manner in which it is attached to the arms 96, 110 and the reel 12 with respect to the embodiment of FIGS. 4 and 5, is substantially identical to that described with respect to the first embodiment of FIGS. 1–3. However, the reel 12 of the embodiment of FIG. 4 has a distinct and unique construction or configuration which enables the reel 12 to be packaged in a very compact manner and assembled on site thus making it easy to package the embodiment of FIG. 4 in a small package which is easily transportable and more easily stored.

The reel 12 of the embodiment of FIG. 4 is comprised of pairs of straps 120, 122 which are arranged orthogonally, one pair with respect to the other. Each pair of straps is comprised of a first and second strap, each having substantially identical construction and arranged as mirror images, one with respect to the other. Thus, the first pair of straps; namely, straps 120 and 122 have a center section or spoke section 124. A center throughbore 126 is defined in the central spoke section 124. The central spoke section 124 extends radially in opposite directions from the central throughbore 126 an approximately equal distance and is connected with a hose support land 128. The land 128 is continuously and integrally formed at an angle with the central spoke section 124 and extends generally parallel to the axis of the central throughbore 126. Each hose land 128 then connects with a radially extending support wall 130. Each strap, such as strap 120 and strap 122, includes a series of holes punched in the central spoke section. Thus, one or two holes may be defined in the support section on other side of the central throughbore 126. Rivets are provided through these holes in order to connect the straps 120 and 122 together. However, a rivet is omitted in at least one pair of the straps on one side of the throughbore 126 so that a nut 132 and bolt 134 may be utilized to hold the straps 120, 122 together. The nut and bolt 132, 134 are not inserted or added to the structure until the pairs of straps are joined together. That is the straps 120, 122 are somewhat flexible particularly at the center spoke section 124. Thus, the straps 120, 122 forming one of the spoke sections of the reel may slide over the strap sections 120, 122 defining the other part of the reel. The throughbores 126 are then aligned and the reel is than attached onto the axle 28. The nut and bolt 132, 134 hold the reel components in assembled condition.

Thus, it can be seen that the pairs of straps 120, 122 forming the reel may be boxed in a disassembled condition, ready for assembly on site by joining together in the orthogonal configuration depicted, and then placed on one end of the axle 28 and attached thereto in the manner described previously.

The invention is susceptible to changes or alterations without defeating its practicability. Therefore, we do not wish to be confined to the preferred embodiment shown in the drawings and described herein.

What is claimed is:

1. Air hose reel apparatus comprising, in combination:

an upright support having an upper end with spaced-apart walls;

a hollow tubular axle journaled in the spaced walls and having first and second ends projecting respectively beyond the space between the walls;

a reel including a hub, radially extending members from the hub, and spaced hose support walls attached to the outer radial end of the radially extending members, said hub including a center throughbore for receipt of first end of the axle beyond the space between the walls, said hub fixed to rotate with the axle, said reel thereby mounted on the axle and rotatable therewith, said axle extending through the hub and terminating at the first end beyond the space between the walls with a fitting for connection to a hose wound on the reel; and a swivel coupling at the second end of the axle beyond the space between the walls for connection to a fluid source.

2. The hose reel of claim 1 wherein the upright support comprises a base, a leg extending from the base, said leg having an upper end defining one wall and a connecting run from the leg to a second wall generally parallel to the first wall.

3. The hose reel of claim 2 wherein the leg includes at least one multi-legged slot for receipt of an air hose nozzle.

4. The hose reel of claim 1 wherein the reel is comprised of at least first and second substantially identical pairs of formed straps, each strap having a central spoke section with the center throughbore, a hose support land at each end of the spoke section and a radially extending support wall from each land, said spoke sections being joined together and said support walls being spaced to retain wound hose there between.

5. The hose reel of claim 4 wherein said pairs of straps are generally orthogonal.

6. The hose reel of claim 4 wherein one of said pairs of straps is comprised of straps releasably attached, at lease in part, to each other whereby the straps may be assembled and disassembled into a reel configuration.

7. Air hose reel apparatus comprising, in combination:

an upright support comprising a base, a leg extending upwardly from the base, said leg having an upper end defining one wall and a connecting run from the leg to a second wall generally parallel to and spaced from the first wall, said leg including at least one multi-legged slot for receipt of an air hose nozzle;

a hollow tubular axle journaled in the spaced walls and having first and second ends projecting respectively beyond the space between the walls;

a reel including a hub, radially extending members from the hub and spaced hose support walls attached to the outer radial end of the radially extending members, said hub including a center throughbore for receipt of the first end of the axle, said hub fixed to rotate with the axle, said reel thereby mounted on the axle and rotatable therewith, said axle extending through the hub and terminating at the first end with a fitting for connection to a hose wound on the reel; and a swivel coupling mount at the second end of the axle for connection to a fluid source.

* * * * *